US009849493B2

(12) United States Patent
Aigner et al.

(10) Patent No.: US 9,849,493 B2
(45) Date of Patent: Dec. 26, 2017

(54) BENDING MACHINE AND METHOD FOR BENDING A SHEET METAL WORKPIECE

(71) Applicant: TRUMPF Maschinen Austria GmbH & Co. KG., Pasching (AT)

(72) Inventors: Wolfgang Aigner, Sattledt (AT); Bernhard Fischereder, Ottnang am Hausruck (AT); Stefano Speziali, Foligno (IT); Thomas Weiss, Linz (AT)

(73) Assignee: TRUMPF Maschinen Austria GmbH & Co. KG., Pasching (AT)

( * ) Notice: Subject to any disclaimer, the term of this patent is extended or adjusted under 35 U.S.C. 154(b) by 0 days.

(21) Appl. No.: 14/915,751

(22) PCT Filed: Aug. 27, 2014

(86) PCT No.: PCT/AT2014/050187
§ 371 (c)(1),
(2) Date: May 3, 2016

(87) PCT Pub. No.: WO2015/027265
PCT Pub. Date: Mar. 5, 2015

(65) Prior Publication Data

US 2016/0236254 A1 Aug. 18, 2016

(30) Foreign Application Priority Data

Sep. 2, 2013 (AT) ..... A 50538/2013

(51) Int. Cl.
*B21D 5/01* (2006.01)
*B21D 5/00* (2006.01)

(52) U.S. Cl.
CPC ..... *B21D 5/01* (2013.01); *B21D 5/006* (2013.01)

(58) Field of Classification Search
CPC ... B21D 5/01; B21D 5/02; B21D 5/04; B21D 5/042; B21D 5/045
See application file for complete search history.

(56) References Cited

U.S. PATENT DOCUMENTS 5,462,424 A 10/1995 Kuroyone
5,694,801 A 12/1997 Takahashi et al.
(Continued)

FOREIGN PATENT DOCUMENTS

EP 0 576 796 A1 1/1994
EP 0 476 092 B1 5/1994
(Continued)

OTHER PUBLICATIONS

International Search Report of PCT/AT2014/050187, dated Jan. 8, 2015.

*Primary Examiner* — Debra Sullivan
(74) *Attorney, Agent, or Firm* — Collard & Roe, P.C.

(57) ABSTRACT

The invention relates to a bending machine (1) for bending a sheet metal workpiece (2), comprising at least three bending punches (4,5,6) which respectively have working edges (7,8,9) which are aligned parallel with one another. Relative to an initial plane (3) in which a bend section (10) to be made in the sheet metal workpiece (2) lies, the first and the second bending punch (4,5) are positioned on one side and the third bending punch (6) is positioned on the opposite side of the initial plane (3). The working edge (9) of the third bending punch (6) is displaceable between the working edges (7,8) of the first and second bending punches (4,5). The third bending punch (6) has at least one rotary and one translatory degree of freedom in a reference plane oriented at a right, angle to a working edge (7,8,9). The second bending punch (5) has three degrees of freedom in the reference plane (19).

19 Claims, 6 Drawing Sheets

(56) References Cited

U.S. PATENT DOCUMENTS

Figure 1:
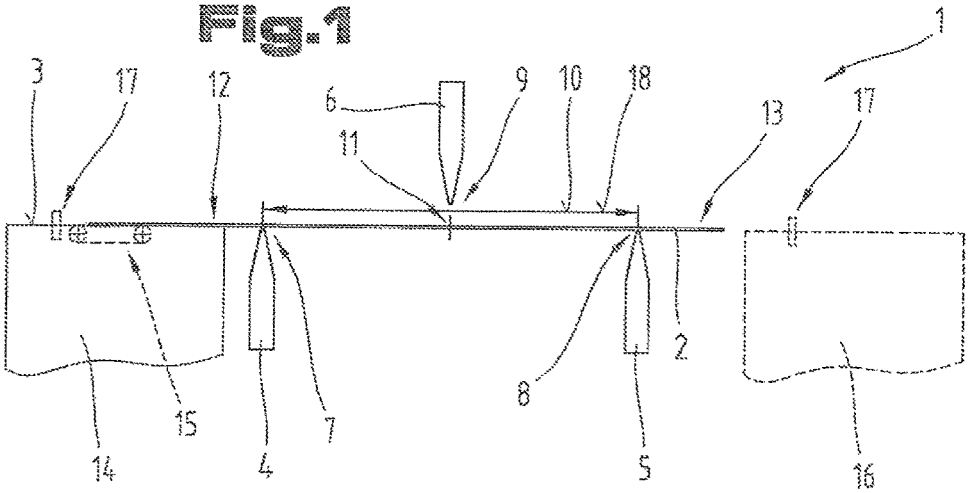

| | | | | |
|---|---|---|---|---|
| 6,185,975 | B1 * | 2/2001 | Nicoletti | B21D 5/015 72/306 |
| 7,415,857 | B1 | 8/2008 | Petricio Yaksic | |
| 8,322,176 | B2 | 12/2012 | Johnson et al. | |
| 2004/0035178 | A1 * | 2/2004 | Matsumoto | B21D 5/02 72/389.8 |

FOREIGN PATENT DOCUMENTS

| | | | |
|---|---|---|---|
| GB | 959 752 | A | 6/1964 |
| WO | 97/18907 | A1 | 5/1997 |

* cited by examiner

BENDING MACHINE AND METHOD FOR BENDING A SHEET METAL WORKPIECE

CROSS REFERENCE TO RELATED APPLICATIONS

This application is the National Stage of PCT/AT2014/050187 filed on Aug. 27, 2014, which claims priority under 35 U.S.C. §119 of Austrian Application No. A 50538/2013 filed on Sep. 2, 2013, the disclosure of which is incorporated by reference. The international application under PCT article 21(2) was not published in English.

The invention relates to a bending machine comprising at least three bending punches which respectively have working edges which are aligned parallel with one another, and a method for bending a sheet metal workpiece on such a bending machine.

A bending machine is known from EP 0 476 092 B1, in which an upper punch can be moved relative to a frame transversely to the sheet plane from an upper retracted position into a lower working position and back. Two lower bending punches are disposed on the frame opposite this punch and the two lower bending punches are mounted in the frame so as to be pivotable about an axis extending in the region where the bend is to be made in the sheet and are coupled with one another by means of a pivot mechanism. Due to the fact that the two lower bending punches are coupled in the pivot mechanism, the two legs of the sheet are bent symmetrically by the upper punch when the sheet is deformed. Furthermore, the upper punch is mounted so as to be pivotable so that sheets with protruding tabs can be bent in a bigger bending angle.

In the case of a bending machine known from U.S. Pat. No. 8,322,176 B2, a sheet metal workpiece to be processed is clamped in its peripheral region by means of a clamping device and is then deformed by two freely displaceable bending punches disposed on the two opposing faces of the sheet. These two bending punches are respectively disposed on a hexapod construction. The fact that the two bending punches exert a force in a region of the sheet on respectively opposing sides of it means that the sheet can be deformed in this local region.

The disadvantage of the design of a bending machine described in EP 0 476 092 B1 is that because the two lower bending punches are coupled, the two legs of the sheet to be processed can only be bent symmetrically. In the same way as with a conventional bending operation on a bending press, the two legs are lifted from an original plane in which the sheet was initially positioned. This is especially problematic in the case of large sheet metal workpieces because it creates an area of danger on either side of the upper bending punch in which the machine operator responsible for positioning the sheet metal workpiece is at risk in the case on a non-automated bending machine. Even in the case of a fully automated bending machine, a pivoting movement of the sheet metal workpiece on both sides is problematic because the manipulating device has to be moved together with the pivoted sheet legs. Another disadvantage is the fact that due to the common axis about which the two bending punches can be pivoted when mounted on the frame, it is not possible to adjust the distance between the two heading punches and thus vary the die width.

The underlying objective of this invention is to propose a bending machine-which guarantees a multiple deformability of the sheet metal workpiece to be processed. Furthermore, it should offer the possibility whereby at least one bend leg of the sheet metal workpiece remains in an initial plane defining the initial position of the sheet metal workpiece during the bending operation. As a result, the safety risk to the machine operator is minimized because the bend leg at least on the side of the bending machine on which the sheet metal workpiece is placed should remain in a stationary position during the bending operation. Furthermore, based on an additional feature of the bending machine, the force peaks of the forces acting on the bending machine during the bending operation are reduced as far as possible. Such a bending machine should also avoid damaging the surface of the sheet metal workpiece during the bending operation. This objective is achieved on the basis of a bending machine having the features according to one aspect of the invention and by the special bending method using said bending machine according to another aspect of the invention. Particularly by using at least three bending punches, each having working edges extending parallel with one another, it is possible to obtain a bending machine whereby the sheet to be processed is in contact with the three working edges of the three bending punches. In addition, the fact that at least the second bending punch has three degrees of freedom in the reference plane and the third bending punch has at least one rotary and translatory degree of freedom relative to the reference plane ensures that during the bending operation, the bending punches can be guided flexibly along any specific path in such a way that one bend leg of the sheet metal workpiece will remain in a position lying in the initial plane during the bending operation. Furthermore, the specific path can be selected so that during the bending operation, relative movement between the sheet metal workpiece und bend leg is kept to a minimum.

A bending machine for bending a sheet metal workpiece as proposed by the invention comprises at least three bending punches which respectively have working edges aligned parallel with one another. By reference to an initial plane in which a bend section to be made in the sheet metal workpiece lies, the first and second bending punches are positioned on one side of the initial plane and the third bending punch is positioned on the opposite side. The working edge of the third bending punch is displaceable between the working edges of the first and second bending punch. The third bending punch has at least one rotary and one translatory degree of freedom in a reference plane oriented at a right angle to a working edge. The second bending punch has three degrees of freedom in the reference plane.

One advantage of the design proposed by the invention, is that due to the high number of degrees of freedom and hence possible movements of the individual bending punches, a bending method can be implemented which, combines the advantages of die bending and folding. For example, due to the flexibility of the bending machine, the bending punch deforming the sheet metal workpiece can be directed along a path in such a way that relative movement between the bending punch and sheet metal workpiece is kept to an absolute minimum, as a result of which the surface of the sheet metal workpiece is protected against damage. Surprisingly, by optimizing the paths of the individual bending punches, not only can the surface of the sheet metal workpiece be protected, the amount of energy needed by the bending machine during the bending operation can also be minimized. This can be attributed to the feet that when there is relative movement between the bending punch and sheet metal workpiece, a considerable amount of energy is converted into heat, in addition to which a certain amount of energy expended for this causes damage to the sheet metal workpiece. Consequently, not only can the quality of the surface of the workpiece to be processed be positively influenced, the amount of energy which has to be exerted on the sheet metal workpiece by the bending press during the bending operation can be reduced. In addition, due to the high flexibility of this bending machine, at least one of the two bending punches is able to remain in any initial plane, which means that it can be accommodated and moved by a manipulating unit coupled with the bending machine without any problem. A major advantage in this respect is the possibility of using a simple manipulating device for bringing in and taking away the sheet metal workpieces, for example a simple conveyor belt Another advantage of the bending machine having the above-mentioned features is that in the case of very large sheet metal workpieces, the space requirement of the bending machine can be reduced due to the fact that, the shorter bend leg is bent and the longer bend leg remains in its initial position.

Furthermore, a supporting body for a sheet metal workpiece defining the initial plane is provided. The advantage of this is that this supporting body may be provided either in the form of a simple supporting table or a special construction for conveying and positioning sheet metal workpieces. If the sheet metal workplaces are brought in manually, the sheet metal workpiece to be processed is placed on the supporting body and positioned with the aid of a stop element. Accordingly, the stop element may be directly integrated in the supporting body. To bring the sheet metal workpieces in on automated basis, it would be conceivable for a conveyor device to be integrated in the supporting body, for example, which is then used to feed in the workpieces to be processed. Furthermore, it may be that, the supporting body can be moved and thus pick up a sheet metal workpiece to be processed from a defined transfer position and then transport, it to the bending machine. To this end, the supporting body may be designed to pivot about a horizontal axis and a vertical axis.

Based, on another embodiment, the third bending punch may have three degrees of freedom. The advantage of this is that it further increases the number of possible operations for which the bending machine can be used and hence the variety of bends that can be produced in sheet metal workpieces. Also as a result of this feature, the "die width" of the bending machine can be adapted by adjusting the distance between the first and second bending punch and the third bending punch can then be positioned symmetrically between these two bending punches.

Furthermore, the first bending punch may have at least one translatory degree of freedom in the reference plane. The advantage of this is that it further increases the number of possible operations for which the bending machine can be used and hence the variety of bends that can be produced in sheet metal workpieces. Based on an embodiment with a translatory degree of freedom in only the horizontal direction, the "die width" can be adjusted, for example. Based on an embodiment with a translatory degree of freedom in the vertical direction, the contact point of the bending punch can be pushed towards the opposite side of the initial plane, for example, and thus to the opposite sheet side, if the first bending punch has more than one degree of freedom, it can be moved, on the basis of the positioning options of the third bending punch.

It may also be that, the first and second bending punch can be moved independently of one another. The advantage of the first and second bending punch being moved independently of one another is that during the bending operation, the first bending punch can be left in its position and only the second bending punch is moved in a sort of pivoting movement for example, in order to bend the sheet metal workpiece. This means that one leg of the sheet metal workpiece being processed can remain in a-horizontal position.

It is also of practical advantage for the three bending punches to be connected to a driving mechanism to enable positioning depending on the number of their degrees of freedom and this will be selected from a group comprising rotary drives, swivel drives, linear actuators or combinations thereof. By degree of freedom in the reference plane is meant the possibility of moving the bending punch in this reference plane. The bending punch, can be moved by one of the drives mentioned above which transmits a travelling and positioning movement to the bending punch. There are various options in terms of transmitting the possible movements to a bending punch depending on its degrees of freedom, as will be explained below. A degree of freedom in the reference plane, for example, means that the bending punch, as viewed in this plane, is able to move in a straight line in one direction. This is achieved by means of a linear actuator which moves the bending, punch. However, a degree of freedom in the reference plane may also mean that the bending punch is able to effect a rotary movement such as a rotation about its working edge. This rotary movement is transmitted either by means of a rotary drive or by a swivel drive. Two degrees of freedom in the reference plane means that the bending punch has either two translatory degrees of freedom, one translatory and one rotary degree of freedom, or two rotary degrees of freedom. Two translatory degrees of freedom can mean that the bending punch can be positioned at every point in the plane but its orientation cannot be changed. This can be achieved by a combination of two linear actuators disposed in a main direction and in a second direction extending perpendicular to it, for example, Naturally, it is not only possible for these linear actuators to be oriented normally with respect to one another, they may also be used to obtain parallel kinematics in which the linear actuators have a common coupling point by means of which this point of the bending punch can be moved freely in the reference plane. A translatory and a rotary degree of freedom can be obtained by a swivel arm with a linear actuator connected to it, for example. Another option is a linear actuator with a rotary head connected to it. The maximum freedom of movement of a bending punch is obtained by three degrees of freedom and an appropriate combination of the drives necessary to achieve them. This will mean that a bending punch can be positioned at each and every point in the range of the bending punch with any orientation of the bending punch. The possibilities for combining drives are many and varied and can be derived from the descriptions given above.

Based on another practical embodiment, at least one of the bending punches is connected to two driving mechanisms, in particular of identical construction, spaced apart in the direction of the working edge. The advantage of this is that a bending punch having a long length along its working edge is supported by a driving mechanism on both sides of its longitudinal extension, thereby enabling forces to be optimally absorbed by the bending punch. The forces acting on the bending punch due to the bending operation can therefore be absorbed symmetrically on either side of the mounted driving mechanisms without torques occurring at the working point of a driving mechanism. It seems to be of advantage if the driving mechanisms mounted on either side of the bending punch are of an identical construction because they have to be able to effect identical movements in order to guide the bending punch given that all the working edges always extend parallel with one another.

Even in the case where it is not necessary for the working edges to extend parallel with one another for a bending operation, it nevertheless seems practical to use a pair of identical drives.

Based on another embodiment, at least one of the bending punches is displaceable in the direction of its working edge or is displaceable about a pivot axis parallel with, the reference plane. The advantage of this embodiment is that on terminating the bending operation, the bending tool can be pivoted outwards, for example to make it easier to remove a processed sheet metal workpiece from the bending machine. Instead of pivoting, it may be that the bending punch can be moved away from its working position linearly along its working edge. In order to keep installation, space for the machine as small as possible, a combination of pivoting and linear movements may be used. This being the case, the bending punch may be moved out halfway linearly, for example, and then pivoted about its middle, so that the space needed for this operation is kept as small as possible.

Based on another advantageous embodiment, at least one of the bending punches has two working edges lying opposite one another. Using two oppositely lying working edges means that the versatility of the bending punch can be increased, thereby also enabling bends to be made in partially opposite directions with this bending punch without the bending punch having to be pivoted 180° relative to its working edge, in this case, the bending punch merely has to be moved to the opposite side of the sheet metal workpiece to enable bending in the opposite direction.

It may also be of practical advantage if at least one of the three bending punches co-operates with an additional bending punch disposed on the opposite side of the initial plane, and the working edges of these two oppositely lying bending punches are directed towards one another. The advantage of such a configuration of the bending machine is that using two oppositely lying bending punches enables the versatility of the bending machine to be increased. Such an arrangement is ideal, especially for producing bends in opposite directions, because the bending punch has to be neither pivoted nor moved to the opposite side of the initial plane in order to produce a bend in the direction opposite a preceding bend. With an arrangement of this type, a bending punch that is positioned for a task that has just been completed merely has to be moved away from the working area of the sheet metal workpiece to be bent and the other bending punch moved into the deployment position instead. With this approach, a series of bends can be produced, each in opposite directions, very quickly and efficiently.

It may also be of advantage to integrate a force measuring element in at least one of the bending punches and/or in its drive device. As a result of this feature, the required bending force can be measured, enabling conclusions to be drawn about the material properties of the workpiece to be processed so that this information can be fed into an active bending angle control system. Furthermore, by means of a force sensor in combination with the knowledge about the current position and geometry of the bending punches, the sheet thickness can be determined, for example, because the force sensor displays a value of a measured force as soon as the sheet metal workpiece has been contacted by all three bending punches and is thus clamped between them. Furthermore, such a force measuring element is able to detect when the sheet metal workpiece is no longer being clamped at the end of a bending operation as it is being released by the bending punches and the sheet metal workpiece has completely rebounded having reached its bend angle, which is preserved due to plastic deformation. From the position of the bending punches, a back-calculation can be made as to what bend angle has just been produced in the sheet metal workpiece. These measurements and calculations can be fed into a statistical evaluation in the control, unit of the bending machine enabling the bending parameters to be adapted for workpieces to be bent in future.

Furthermore, at least one of the bending punches may have at least one stop face. The advantage of providing a stop face in one of the bending punches is that the bending punch can be used as a stop element to enable a sheet metal workpiece to be bent to be positioned particularly accurately, especially if setting up the workpiece manually. This saves on space on the one hand and costs on the other hand because there is no need to provide a separate stop element in the bending machine. It is also of particular advantage to provide one of the bending punches with a stop face because the position and geometry of the bending punches have to be very exactly determined anyway in readiness for operating the bending machine.

Furthermore, a method may be provided for bending a sheet metal workpiece on a bending machine having three bending punches with working edges each disposed parallel with one another, whereby relative to an initial plane in which a bend section to be made in the sheet metal workpiece lies, the first and second bending punch, are positioned on one side and the third bending punch is positioned on the opposite side of the initial plane. The working edge of the third bending punch is displaced between the working edges of the first and second bending punch and the third bending punch is moved in at least one rotary and one translatory direction in a reference plane oriented at a right angle to a working edge. In addition, during the bending operation, the sheet metal workpiece is retained between the first and third working, edges essentially in the initial plane so that a first bend leg is formed and the working edge of the second bending punch is directed along a path about the working edge of the third bending punch so that the bend edge and a second bend leg adjoining it is formed at the third working edge.

The advantage of this is that this method enables a bending machine with three bending punches, to be operated. Such a method combines the advantages of die bending and folding. The advantages of die bending, for example, are that by using three working edges which are in contact with the sheet metal workpiece, a well-defined and very clean bend edge can be produced. Furthermore, by adjusting the die width, the bending force which has to be applied during the bending operation can be very effectively controlled. The advantages of folding, for example, are that during the bending operation, one of the two bend legs of a processed sheet metal workpiece remains in a horizontal initial plane. Furthermore, due to the high flexibility of the bending method described here, the fact that the options for moving the bending punches are freely definable means that they can be set so that there is as little relative movement as possible between the bending punches and sheet metal workpiece. As a result, the surface of the sheet metal workpiece is protected from damage on the one hand, and on the other hand, the energy needed for forming during this bending operation can be minimized. Furthermore, by actively guiding the bending punch in the reference plane, the sheet metal, workpiece is deformed in such a way that either one leg of the sheet metal workpiece remains in a same position as the initial position or both legs are bent by a specific angle relative to the initial plane. As a result of these possibilities, the bending machine is ideal precisely for automated tasks because the position of the workpiece to be processed should be exactly defined for transferring the sheet metal workpiece to a manipulating unit.

Furthermore, the path of the second working edge can be set so that it makes contact with the sheet metal workpiece with as little relative movement as possible during the bending operation. It is of particular advantage to control the bending punch on the basis of this aspect because avoiding relative movements between the bending punches and sheet metal workpiece protects the sheet metal workpiece from being damaged. Such damage might include notching or scratch marks in the sheet metal workpiece, for example. Reducing relative movement also reduces the amount of forming energy needed because a certain amount of energy has to be applied to prevent undesired damage to the workpiece surface in the forms mentioned above.

It may also be expedient, before or during the bending operation, to set and/or adjust the distance between the first and second working edge depending on the workpiece properties. The particular advantage of this is that by changing the distance between the first and second working edge, the "die width" can lie adjusted. As a result, the force peaks of forces acting on the bending machine during the bending operation can be adapted because a bigger distance between the first and second working edges means that the bending moment transmitted by the bending punches to fee sheet metal workpiece is greater for the same active forces of the bending punches. Accordingly, the sheet metal workpiece can be bent more easily. Especially when working with different sheet thicknesses, it is very much of advantage to be able to adjust the "die width" freely because when working with sheet metal workpieces with a greater sheet thickness, the "die width" can simply be increased. This option also enables allowance to be made for fluctuations in sheet thickness which occur due to manufacturing, tolerances in rolled sheets. In addition to these properties of bending force control, the bending radius or shape of the region of the sheet metal workpiece which lies between the working edges of the bending punches can be flexibly adjusted by varying the "die width". The particular advantage of this is that based on the applicant's many years of experience in the bending press sector, calculation programs and a knowledge of three point bending as well as the variable width can all be used for this purpose. As a result, calculation programs used for such a bending operation can be set up with the aid of tried and tested know-how.

During the bending operation, the distances between the third and first working edges and the third and second workings edges may be kept more or less the same size. The advantage of this is that by setting the distances between the working edges of the individual bending punches so that they are more or less the same, the forces acting on the two bend legs of the sheet metal workpiece will be symmetrical. This enables a sheet metal workpiece to be produced on which the bending radius has a uniform curve on the one hand, and the two bend legs of the sheet metal workpiece will also be formed symmetrically in the region close to the bend edge.

It may also be of advantage if the bending punches are directed onto the workpiece surface oriented essentially at a right angle during the bending operation. By orienting a bending punch at a right angle to the workpiece surface is meant that the vertical axis of the bending punch on which the working edge of the bending punch and the point at which force is applied by a driving mechanism lie is also oriented essentially at a right angle to the workpiece surface. As a result of this feature, a bending moment which might occur in the bending punch due to a distance between the working point of the driving mechanism and the force vector of the force exerted on the sheet metal workpiece to be bent is not transmitted.

Furthermore, in order to bend fee sheet metal workpiece in partially opposite directions, the first and/or second bending punch is or are positioned on one side or on the opposite side of the initial plane if necessary before the respective betiding operation. The advantage of this is that the ability to position the bending punches on both sides of the initial plane increases the number of possible bends which can be made in the sheet metal workpiece. The positioning of the bending punches is always such that the first and second bending punches are positioned on one side of the initial plane and the third bending punch is positioned on the opposite side of the initial plane with its working edge between the first and second bending punches. If the bending punches then have to be positioned on the opposite side of the initial plane for a bend in the opposite direction, the orientation of the bending punches must also be adapted accordingly. As a result, the working edge of the bending punches is always oriented in the direction of the sheet metal workpiece to be processed.

In order to bend the sheet metal workpiece in partially opposite directions, it may be of advantage to use an additional bending punch disposed opposite one of the three bending punches but only three bending punches are ever in active use during the bending operation. The advantage of using additional bending punches which essentially mirror one of the three bending punches on either side of the initial plane is there is no need to move one of the three, bending punches to the other side of the initial plane in order to make a bend in an opposite direction because the other bending punch can be used instead of one of the three bending punches when making a bend in the opposite direction. Downtime of the machine can be reduced as a result because the operation of positioning the bending punches is shorter.

When introducing or removing a sheet metal workpiece, it may also be of advantage to remove at least one of the bending punches from the working area in the direction of its working edge or about a pivot axis parallel with the reference plane. This also makes it possible to produce sheet metal workpieces with bend legs of a greater length and which are difficult to produce by the conventional method of die bending or folding. Furthermore, in terms of manipulating the sheet, it as far as possible avoids the need for the complicated processes involved in threading out the sheet metal workpiece.

Finally, the sheet thickness and/or the bend angle can be calculated by determining the position of a bending punch and measuring the force applied to the sheet metal workpiece to be bent. The advantage of this is that the position of the bending punch is known in any case and is pre-set by the control unit of the bending machine. The geometry of the bending punches is also known. By measuring the force applied to the workpiece, the sheet thickness and/or bend angle can therefore be calculated. Furthermore, by measuring the bending force during the bending operation, it is also possible to integrate the anticipated rebound of the sheet metal workpiece in the calculations to determine the bend angle already, which means that potential flexing can be avoided. By detecting the sheet thickness and the force to be applied during the bending operation in particular, it is possible to predict the bending behavior of the sheet, metal workpiece on the basis of statistical records, thereby enabling the final bend angle to be accurately calculated beforehand.

To provide a clearer understanding, the invention will be described in more detail below with reference to the appended drawings.

Figure 2:
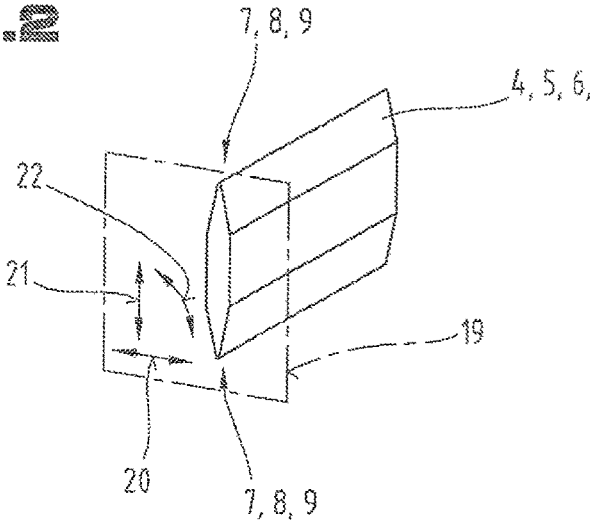
Figure 3:
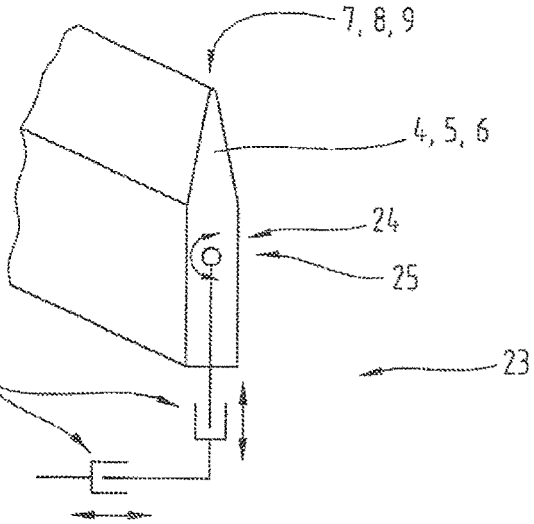
Figure 6:
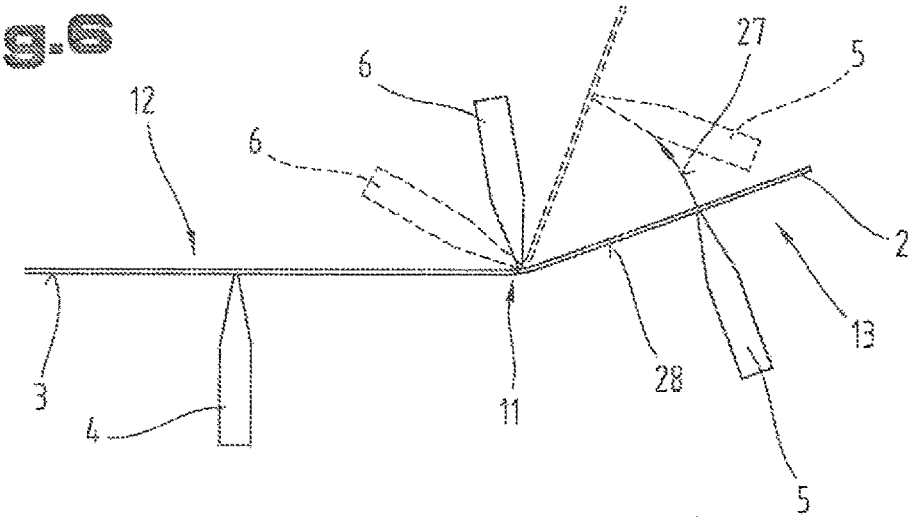
Figure 7:
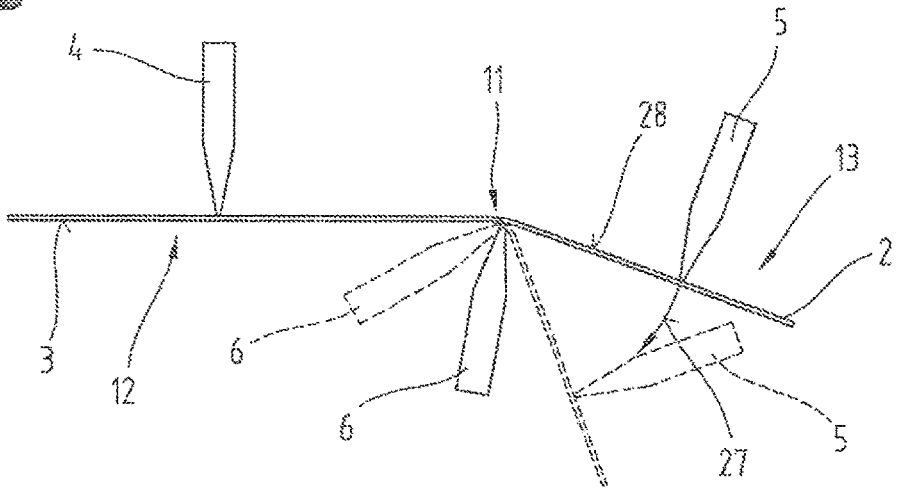
Figure 8:
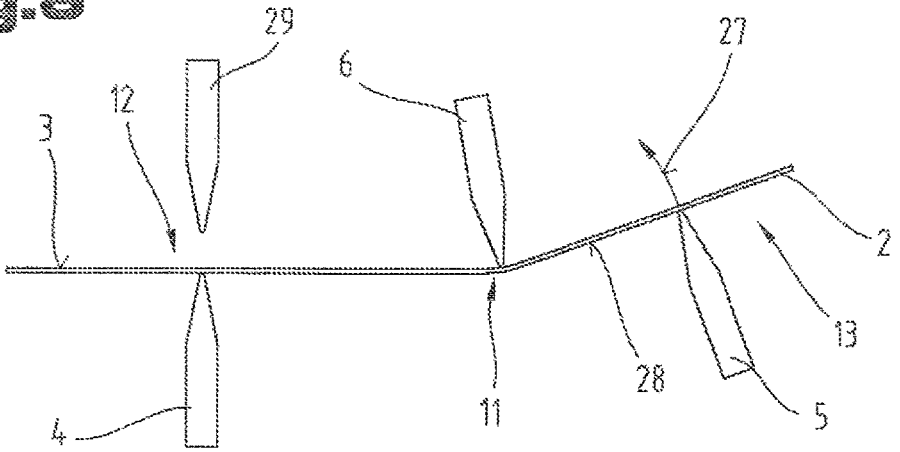
Figure 9:
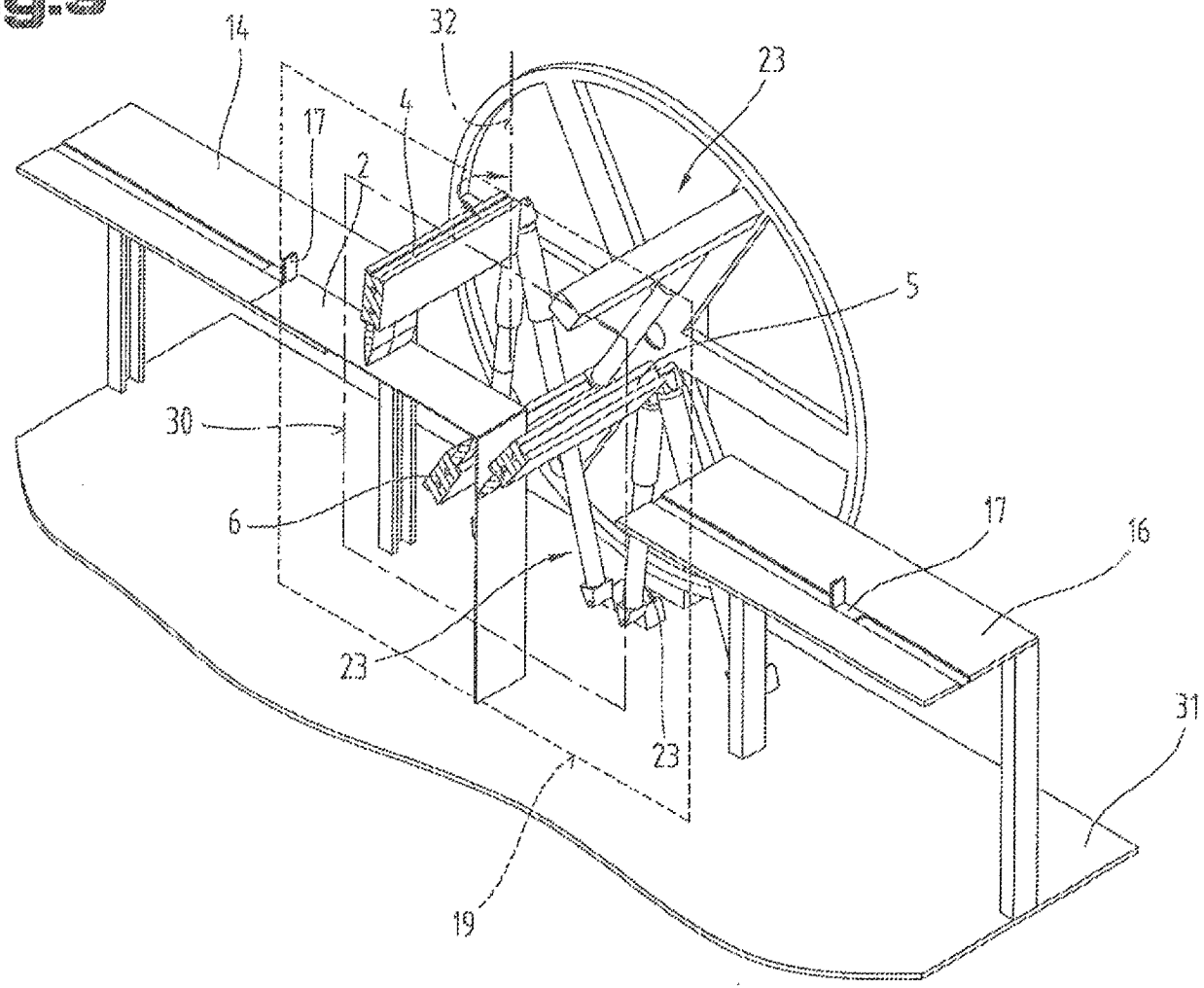
Figure 10:
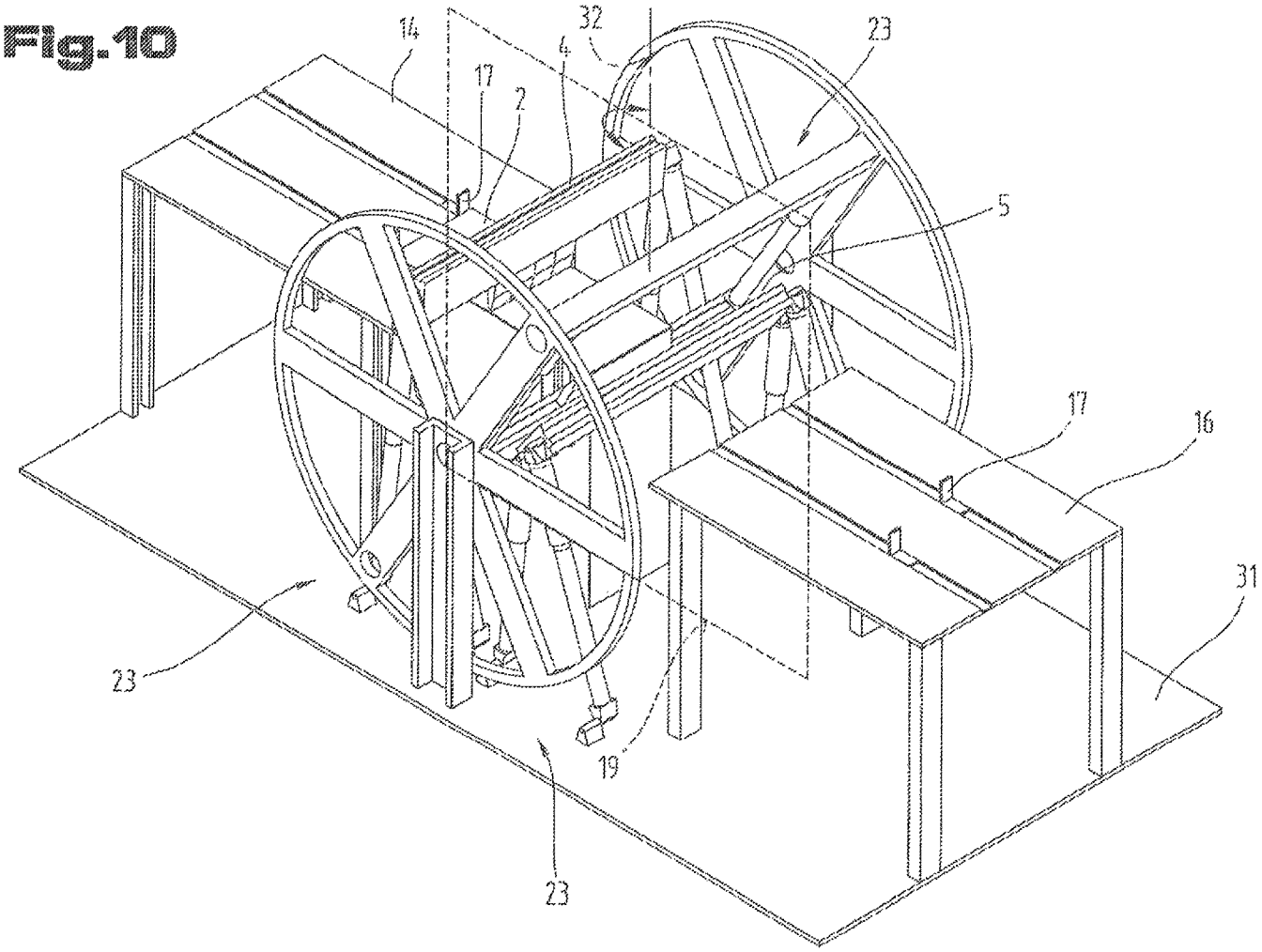
Figure 11:
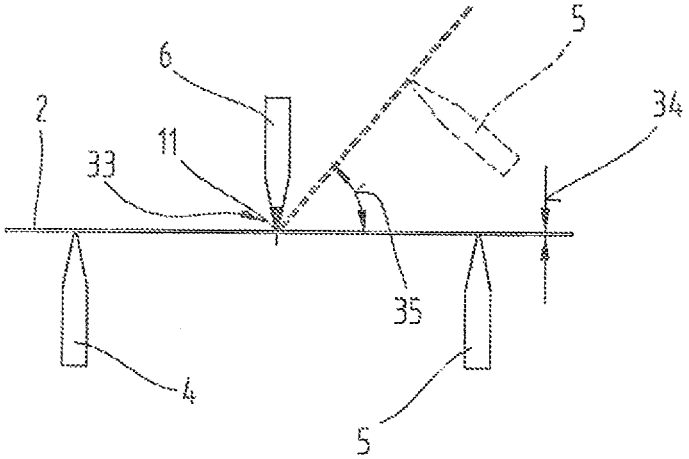
Figure 12:
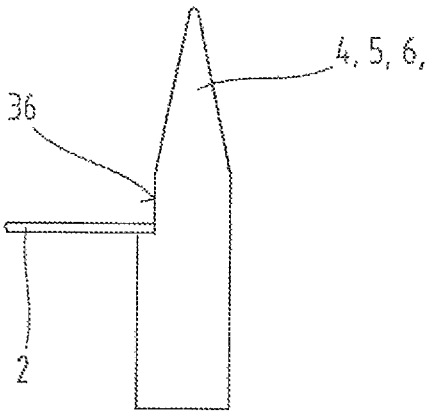

These are highly simplified, schematic diagrams illustrating the following:

FIG. 1 an overall view of a bending machine with three bending punches;

FIG. 2 a perspective view of a section through a bending punch with two working edges lying opposite one another;

FIG. 3 a perspective view of a bending punch with a driving mechanism;

FIG. 4 a combination of options for operating a driving mechanism which guarantees one degree of freedom for a bending punch in a plane;

FIG. 5 a combination of options for operating a driving mechanism which guarantees two degrees of freedom, for a bending punch in a plane;

FIG. 6 a combination of options for operating a driving mechanism which guarantees one degree of freedom for a bending punch;

FIG. 7 an illustration of the sequences of movements of the bending punch during a bending operation;

FIG. 8 an illustration of the sequences of movements of the bending punch during a bending operation in the opposite direction;

FIG. 9 a perspective view of a section of one possible embodiment for operating a bending machine with three bending punches;

FIG. 10 a perspective view of another possible embodiment for operating a bending machine with three bending punches;

FIG. 11 a schematic diagram illustrating possible ways of measuring the sheet thickness and determining the bend angle of a sheet metal workpiece;

FIG. 12 a bending punch, with an integrated stop face

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in-terms of meaning to a new position when another position is being described.

FIG. 1 is an exemplary diagram, illustrating a section through a bending machine 1 and a sheet metal workpiece to be processed 2, which is oriented in an initial plane 3. The sheet metal workpiece 2 is essentially lying on a first bending punch 4 and on a second bending punch 5. A third bending punch 6 is positioned on the opposite side of the initial plane 3. The three bending punches 4, 5, 6 are in contact with the sheet metal workpiece 2 to be bent essentially at their working edges 7, 8, 9. Lying between the working edges 7 and 8 of the first and second bending punches 4 and 5 is the bend section 10 in which the sheet metal workpiece 2 will essentially be formed. Bending punches 4, 5 act in a manner akin to a die serving as a bottom tool of a bending press and the third bending punch 6 acts in a manner akin to a top tool of a bending press. When all three bending punches 4, 5, 6 are in contact with the sheet metal workpiece 2 to be processed, the highest bending moment is transmitted to the sheet metal workpiece 2 at the bend edge 11. This bend edge 11 is virtually consistent with the third, working edge 9 of the third bending punch 6. The bend edge 11 divides the sheet metal workpiece 2 within the bend section 10 into a first bend leg 12 and a second bend leg 13. During the bending operation, these two head legs 12, 13 are deformed only in their part lying within the bend section 10. As may be seen from this schematic diagram, the sheet metal workpiece 2 to be processed is also lying on a supporting body 14 in addition to the first bending punch 4 and second bending punch 5. The supporting body 14 may be pro vided in the form of a simple supporting table which merely serves to support the sheet metal workpiece 2. This is of particular advantage if the sheet metal workpiece is very large. It is also possible for the supporting body 14 to incorporate a conveyor device 15 which is responsible for manipulating the sheet metal workpiece 2. Such a conveyor device 15 might be a conveyor belt integrated in the supporting body 14, for example, which is used to transport the sheet metal workpiece 2.

For particularly long sheet metal workpieces 2 with long bend legs 12, 13, it would also be conceivable for an additional supporting body 16 to be provided, on which the sheet metal workpiece 2 can lie. Another option is to provide a stop element 17 which can be used to position the sheet metal workpiece 2. This stop element 17 may either be a stand-alone element or may be integrated in a supporting body 14, 16. It would naturally also be possible for the stop element 17 to be used not only for positioning tasks but also to manipulate the sheet at the same time.

By displacing the first bending punch 4 and/or the second bending punch 5, the distance 18 between the two bending punches 4, 5 which essentially defines the bend section 10 can be set. In this respect, it is of advantage if the third bending punch 6 is positioned in such a way between the first bending punch 4 and second bending punch 5 that it lies symmetrically between the two bending punches 4, 5.

FIG. 2 is a perspective view illustrating a bending punch 4, 5, 6, the section representing a reference plane 19. The bending punch 4, 5, 6 illustrated in this view has a working edge 7, 8, 9 at both ends of its vertical extension. This being, the case, it can be used so that it can make contact with the sheet metal workpiece 2 by means of its working edge 7, 8, 9 on either side of the initial plane 3, which means that it does not have to be pivoted in order to be used on the opposite side of the initial plane 3. This means that a bend can easily be made in a sheet metal workpiece 2 in the opposite direction with such a bending punch 4, 5, 6.

FIG. 2 illustrates the possible options for movements, also referred to as degrees of freedom, by which the bending punches 4, 5, 6 can be moved in the reference plane 19. The possible movements are in a horizontal direction 20 corresponding to a guiding direction along the initial plane 3, a vertical direction 21 corresponding to a direction normal to the initial plane 3 and a direction of rotation 22 corresponding to a rotation of the bending punch 4, 5, 6 in the reference plane 19. Due to the combination of guiding options along a horizontal direction 20 and a vertical direction 21, the bending punch 4, 5, 6 is in principle able to reach every point in the reference plane 19. Due to a further option of moving in the direction of rotation 22, not only can every point in the reference plane 19 be reached, the orientation of the bending punch 4, 5, 6 can also be varied at any of these points.

FIG. 3 is a schematic illustration of how a combination of different driving mechanisms 23 can be set up in order to position a bending punch 4, 5, 6 anywhere in the reference plane 19. In order to move a bending punch 4, 5, 6, it is necessary to couple it with a driving mechanism 23. This driving mechanism is responsible for positioning the bending punch 4, 5, 6 in the reference plane 19. Depending on the number der degrees of freedom of a bending punch 4, 5, 6, there are various options in terms of the driving mechanism 23 based on combinations of different rotary drives 24, swivel drives 25 and linear actuators 26.

Figure 4A:
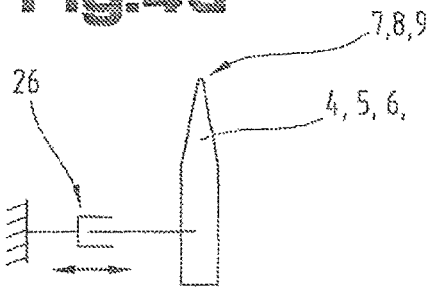
Figure 4B:
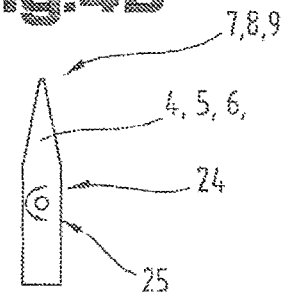

FIGS. 4*a* and 4*b*, as well as FIGS. 5*a* to 5*e* illustrate several possible combinations of drives, for moving a bending punch 4, 5, 6 in the reference plane 19.

FIGS. 4*a* and 4*b* illustrate the simplest embodiment of a drive combination in which one degree of freedom is provided by one driving mechanism 23. This can be achieved either as illustrated in FIG. 4*a* by a linear actuator 26 or as illustrated in FIG. 4*b* by a rotary drive 24 or swivel drive 25. As a result, either the position of a bending punch 4, 5, 6 in one direction can be changed or the position of the bending punch 4, 5, 6 in the reference plane 19 can be changed.

Figure 5A:
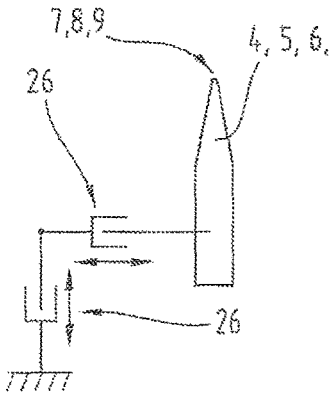
Figure 5B:
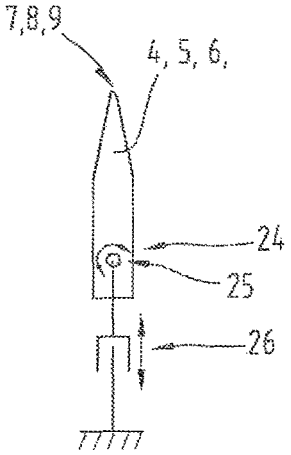
Figure 5C:
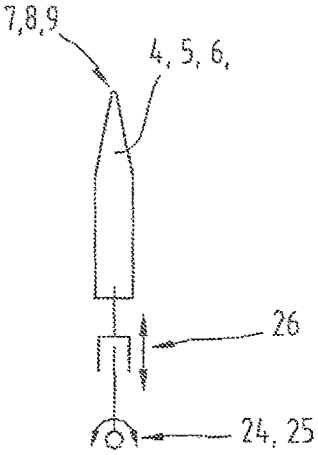
Figure 5D:
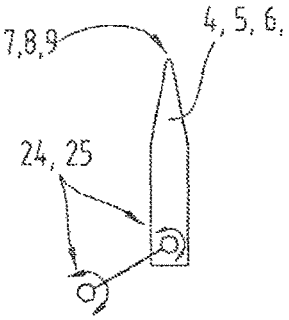
Figure 5E:
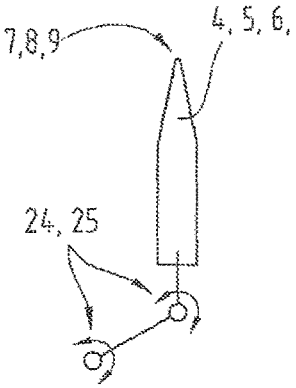

FIG. 5*a* to FIG. 5*e* illustrate different arrangements whereby two degrees of freedom to move are imparted, to the bending punch 4, 5, 6, this being achieved by the co-operating drives. Firstly, as illustrated in FIG. 5*a*, two degrees of freedom can be obtained by a combination of two linear actuators 26 and these need not necessarily be at a right angle to one another. In this instance, the bending punch 4, 5, 6 can be moved into every position in the reference plane 19 but its orientation cannot be changed. Another option is a combination of rotary or swivel drives 24, 25 and a linear actuator 26. In this respect, as viewed from a machine frame, the linear actuator 26 may be connected in front, of the rotary or swivel drive 24, 25 as illustrated in FIG. 5*b*, or the rotary or swivel drive 24, 25 may be connected in front of the linear actuator as illustrated in FIG. 5*c*. Another possibility, as illustrated in FIGS. 5*d* and 5*e*, is to combine two rotary or swivel drives 24, 25, in which, case they can be installed in different positions of the driving mechanism 23. A combination of these drives also means that either the positioning or the position of the bending punch 4, 5, 6 are not freely selectable.

Based on the examples illustrated here, a combination of driving mechanism, is possible whereby three drives can be used to move the bending punches 4, 5, 6 to any position in the reference plane 19 and orient them. In view of the large number of examples of possible embodiments, these will not all be described and Illustrated in detail because the individual options can be put together in any case by combining the embodiments illustrated as examples in FIGS. 4 and 5.

FIG. 6 is a schematic diagram illustrating a sequence of a bending operation. The sheet metal workpiece 2, having been clamped between the bending punches 4, 5, 6, is bent by the movement of bending punch 5 along a path 27. During die bending operation, the third bending punch 6 may also be tilted in order to achieve an optimum bending result.

The travel path 27 of the second bending punch 5, especially the working edge 7, should be selected so that as far as possible, very little relative movement occurs between the bending punch 5 and sheet metal workpiece 2. Not only is this gentle on the workpiece surface 28, the amount of energy needed for the bending operation can also be minimized. The third bending punch 6 should also be moved with the sheet metal workpiece 2 in such a way that no relative movement occurs between it and the sheet metal workpiece 2. During the bending operation, as illustrated in FIG. 6, the first bend leg 12 remains horizontal and the second bend leg 13 is pushed upwards by the second bending punch 5. The sheet metal workpiece 2 is mainly deformed at the bend edge 11.

FIG. 7 is the same schematic diagram of a bending operation as that shown in FIG. 6 but in this instance, the second bend leg 13 is not bent upwards and instead the second bend leg 13 is bent downwards in the opposite direction. To this end, it is necessary for all three bending punches 4, 5, 6 to be moved respectively to the opposite side of the initial plane. On the second side of the initial plane, the bending punches 4, 5, 6 must then each be pivoted 180° so that their working edges 7, 8, 9 are directed towards the sheet metal workpiece to be processed 2 again. To avoid having to carry out this pivoting operation, it would also be conceivable to use a bending punch such as that illustrated in FIG. 2 having two working edges 7, 8, 9 lying opposite one another.

FIG. 8 is a similar schematic diagram illustrating the layout of bending punches 4, 5, 6, as illustrated in FIG. 6 but in this instance for a bend to be made in the opposite direction where, unlike FIG. 7, the bending punches 4, 5, 6 do not have to be moved to the other side of the initial plane 3 because at least one additional bending punch 29 is provided which is not actively engaged during the bending operation, on one side but is used as a replacement for the respective bending punch 4, 5, 6 for a bending operation on the other side so that the bending punches 4, 5, 6 do not have to be moved to the other side of the reference plane 19, nor does their orientation have to be changed.

FIG. 9 illustrates one possible set-up of such a bending machine with three bending punches. In this instance, the first bending punch 4 and second bending punch 5 are each coupled with a driving mechanism 23 comprising two linear actuators and a swivel drive. By means of this driving mechanism 23, the bending punches 4, 5 can be freely positioned in a certain working area 30 of the bending machine lying within the reference plane 19. The driving mechanism 23 connects bending punches 4, 5 to the machine frame 31. Also connected to the machine frame 31 is a driving mechanism. 23 for the third bending punch 6 comprising a rotary drive and a linear actuator. The third bending punch 6 can therefore be pivoted in terms of its working edge 9 and can also be moved towards the sheet metal workpiece 2 or moved away from it. The bending machine is illustrated in section through the reference plane 19, which is disposed exactly in the middle of the bending machine. The second half of the bending machine, not illustrated, is of a symmetrical design with the half of the bending machine illustrated in FIG. 9. To enable the sheet metal workpiece to be threaded out after a bending operation, it seems to be of practical advantage if the bending punches 4, 5, 6 can respectively be pivoted about a pivot axis 32 out of the working area 30 so that the sheet can be easily removed from the bending machine. This operation of pivoting the bending punches 4, 5, 6 may also be necessary if they have to be positioned on the opposite side of the initial plane 3 for making a bend in the opposite bending direction.

FIG. 10 illustrates the bending machine from FIG. 9 but not in section. The driving mechanisms 23 of the respective bending punches 4, 5, 6 are illustrated on either side of the bending punch 4, 5, 6. The bending punches 4, 5, 6 are attached to these driving mechanisms 23.

FIG. 11 is a schematic diagram in which a force measuring element 33 is attached to the third bending punch 6 and by means of this force measuring element 33 and by determining the position of the bending punch 4, 5, 6, the sheet thickness 34 as well as the bend angle 35 can be determined. The sheet thickness 34 can be determined, by moving all of the bending punches 4, 5, 6 into an upright position. The sheet metal workpiece 2 is then, placed on the first bending punch 4 and second bending punch 5. The third bending punch 6 is then moved downwards until the force measuring element 33 has reflected a value back to the machine controller, recording when the third bending punch 6 made contact with the sheet metal workpiece 2. Since the positions of the individual bending punches 4, 5, 6 are very accurately predefined by the machine controller and can be retrieved at any time, the sheet thickness 34 can be calculated.

The method by which the bend angle is determined is as follows. When the sheet metal workpiece 2 is bent, a plastic as well as an elastic deformation occurs during the bending operation. If the sheet metal workpiece 2 is bent beyond its elastic component, i.e. is bent too far, the sheet metal workpiece 2 rebounds by its elastic component as the bending punches 4,5,6 are retracted. When the force on the force measuring element 33 is zero, the bend angle 35 that will continue to be preserved due to plastic deformation, is reached. Using the geometry and position of the individual bending punches 4, 5, 6, a calculation can then be made back to the resultant bend angle.

The force measuring element 33 may be a piezo-element, for example, which is integrated in the bending punches 4,5,6. However, it may also be connected between the bending punches 4,5,6 and driving mechanisms 23 in order to detect the forces acting on the bending punches 4,5,6.

FIG. 12 illustrates another embodiment of a bending punch 4, 5, 6 in which a stop face 36 is provided in the bending punch 4, 5, 6 against which the sheet metal workpiece 2 may sit.

FIGS. 1-12 illustrate what may be construed as separate and independent embodiments of the bending machine 1, the same reference numbers and component names being used for parts that are the same. The diagrams and description relate to examples of embodiments and examples of arrangements of the bending punches 4, 5, 6. The description of the individual arrangements is based on existing bending presses or folding machines. It should therefore be pointed out that certain components of a bending machine in which, the bending punches 4, 5, 6 are integrated, for example press beams or a control unit, are not explicitly described because these are generally known components which are naturally used in this bending machine.

The embodiments illustrated as examples represent possible variants of the bending machine 1, and it should be pointed out at this stage that the invention is not specifically limited to the variants specifically illustrated, and instead the individual variants may be used in different combination s with one another and these possible variations lie within the reach of the person skilled in this technical field given the disclosed technical teaching.

Furthermore, individual features or combinations of features from the different embodiments described and illustrated as examples may be construed as independent and inventive solutions.

The objective underlying the independent inventive solutions may be found in the description.

All the figures relating to ranges of values in the description, should be construed as meaning that they include any and all part-ranges, in which case, for example, the range of 1 to 10 should be understood as including all part-ranges starting from the lower limit of 1 to the upper limit of 10, i.e. all part-ranges starting with a lower limit of 1 or more and ending with an upper limit of 10 or less, e.g. 1 to 1.7, or 3.2 to 8.1 or 5.5 to 10.

For the sake of good order, finally, it should be pointed out that, in order to provide a clearer understanding of the structure of the bending machine 1, it and its constituent parts are illustrated to a certain extent out of scale and/or on an enlarged scale and/or on a reduced scale.

LIST OF REFERENCE NUMBERS

1 Bending machine
2 Sheet metal workpiece
3 Initial plane
4 First bending punch
5 Second bending punch
6 Third bending punch
7 First working edge
8 Second working edge
9 Third working edge
10 Bend section
11 Bend edge
12 First bend leg
13 Second bend leg
14 Supporting body
15 Conveyor device
16 Other supporting body
17 Stop element
18 Distance
19 Reference plane
20 Horizontal direction
21 Vertical direction
22 Direction of rotation
23 Driving mechanism
24 Rotary drive
25 Swivel drive
26 Linear actuator
27 Path
28 Workpiece surface
29 Additional bending punch
30 Working area
31 Machine frame
32 Pivot axis
33 Force measuring element
34 Sheet thickness
35 Bend angle
36 Stop face

The invention claimed is:

1. Bending machine for bending a sheet metal workpiece, comprising at least first, second, and third bending punches, which respectively have first, second, and third working edges which are aligned parallel with one another, wherein relative to an initial plane in which a bend section to be made in the sheet metal workpiece lies, the first and second bending punch are positioned on one side and the third bending punch is positioned on the opposite side of the initial plane, wherein the third working edge is displaceable between the second and the first working edges, wherein the third bending punch has at least one rotary and one translatory degree of freedom in a reference plane oriented at a right angle to at least one of the first and the second working edges, wherein the second bending punch has three degrees of freedom in the reference plane, wherein a supporting body defining the initial plane is provided for the sheet metal workpiece, and wherein the first bending punch has at least one translatory degree of freedom in the reference plane, wherein the bending machine is configured such that during bending operation a first bend leg of the sheet metal workpiece remains horizontal and a second bend leg of the sheet metal workpiece is pushed upwards or downwards, wherein a bend edge divides the sheet metal workpiece within a bend section into the first bend leg and the second bend leg, wherein the first bend leg and the second bend leg are oriented at a bend angle to each other.

2. Bending machine according to claim 1, wherein the third bending punch has three degrees of freedom.

3. Bending machine according to claim 1, wherein the first and the second bending punch can be moved independently of one another.

4. Bending machine according to claim 1, wherein to enable positioning and depending on the number of their degrees of freedom, the first, the second, and the third bending punches are connected to a driving mechanism selected from a group comprising rotary drives, swivel drives, linear actuators or combinations thereof.

5. Bending machine according to claim 4, wherein at least one of the first, the second, and the third bending punches is connected to two driving mechanisms spaced apart from one another in the direction of the first, the second, or the third working edge, respectively.

6. Bending machine according to claim 4, wherein at least one of the first, the second, and the third bending punches is displaceable in the direction of its working edge or is displaceable about a pivot axis parallel with the reference plane.

7. Bending machine according to claim 4, wherein a force measuring element is integrated in at least one of the bending punches and/or in the driving mechanism.

8. Bending machine according to claim 1, wherein at least one of the first, the second, and the third bending punches has two working edges lying approximately opposite one another.

9. Bending machine according to claim 1, wherein at least one of the first, the second, and the third bending punches co-operates with an additional bending punch which is disposed on the opposite side of the initial plane, and wherein the working edges of these two oppositely lying bending punches are directed towards one another.

10. Bending machine according to claim 1, wherein at least one of the first, the second, and the third bending punches has at least one stop face.

11. Method of bending a sheet metal workpiece, the method comprising steps of:

providing a bending machine having a first bending punch having a first working edge, a second bending punch having a second working edge, and a third bending punch having a third working edge, the first working edge, the second working edge, and the third working edge being aligned parallel with one another, placing a sheet metal workpiece in an initial plane, such that the first and second bending punch are positioned on one side and the third bending punch is positioned on the opposite side of the initial plane, and performing a bending operation comprising:

moving the third working edge between the first and the second working edges in at least one rotary and one translatory direction in a reference plane oriented at a right angle to at least one of the first and second working edges, retaining the sheet metal workpiece between the first working edge and the third working edge essentially in the initial plane so that a first bend leg is formed, wherein the first bend leg remains horizontal, and directing the second working edge along a path about the third working edge so that a bend edge and a second bend leg adjoining the bend edge are formed at the third working edge, wherein the second bend leg is pushed upwards or downwards, wherein the bend edge divides the sheet metal workpiece within a bend section into the first bend leg and the second bend leg, wherein the first bend leg and the second bend leg are oriented at a bend angle to each other.

12. Method according to claim 11, wherein the path of the second working edge is set so that it makes contact with the sheet metal workpiece with as little relative movement as possible during the bending operation.

13. Method according to claim 11, wherein before or during the bending operation, the distance between the first and the second working edges is set and/or adjusted depending on workpiece properties.

14. Method according to claim 11, wherein during the bending operation, the distances between the third and the first working edges and the third and the second working edges may be kept more or less the same size.

15. Method according to claim 11, wherein the first, the second, and the third bending punches are directed onto the workpiece surface oriented essentially at a right angle during the bending operation.

16. Method according to claim 11, wherein in order to bend the sheet metal workpiece in partially opposite directions, the first and/or the second bending punch is or are positioned on one side or on the opposite side of the initial plane if necessary before the respective bending operation.

17. Method according to claim 11, wherein in order to bend the sheet metal workpiece in partially opposite directions, a fourth bending punch is used which is disposed lying opposite one of the three bending punches but only three of the first, the second, the third, and the fourth bending punches are ever in active use during the bending operation.

18. Method according to claim 11, wherein in order to introduce or remove a sheet metal workpiece, at least one of the first, the second, and the third bending punches is removed from the working area in the direction of its working edge or about a pivot axis parallel with the reference plane.

19. Method according to claim 11, wherein a sheet thickness of the sheet metal workpiece and/or a bend angle can be calculated by determining a position of at least one of the first, the second, and the third bending punches and measuring a force applied to the sheet metal workpiece.

* * * * *